United States Patent [19]

Watkins

[11] Patent Number: 4,844,107

[45] Date of Patent: Jul. 4, 1989

[54] PORTABLE STANDING AND SEATING AID

[76] Inventor: Edward K. Watkins, 172 Elsia Dr., Front Royal, Va. 22630

[21] Appl. No.: 226,535

[22] Filed: Jul. 29, 1988

[51] Int. Cl.[4] ..... A45B 1/00

[52] U.S. Cl. ..... 135/65; 135/67

[58] Field of Search ..... 135/65, 67; 5/503, 507

[56] References Cited

U.S. PATENT DOCUMENTS

| | | | |
|---|---|---|---|
| 2,963,713 | 12/1960 | Forrest | 5/503 |
| 2,981,959 | 5/1961 | Burnham | 5/503 |
| 3,553,746 | 1/1971 | Seiger | 5/503 |
| 3,591,874 | 7/1971 | O'Kennedy | 5/503 |
| 3,911,509 | 10/1975 | Fleckenstein | 5/503 X |

FOREIGN PATENT DOCUMENTS

| | | | |
|---|---|---|---|
| 3112315 | 10/1982 | Fed. Rep. of Germany | 135/65 |

*Primary Examiner*—Henry E. Raduazo

*Attorney, Agent, or Firm*—Spencer & Frank

[57] ABSTRACT

A portable standing and sitting aid or device which comprises a base plate for allowing the feet of a person to be placed thereon and at least one support arm connected to the base plate in an initial position for permitting the person to grasp the support arm thereby allowing the person's arm and shoulder to assist in the standing or sitting operation. The support arm is removable from the initial position to assist in easily moving the device from room to room.

16 Claims, 2 Drawing Sheets

PORTABLE STANDING AND SEATING AID

FIELD OF THE INVENTION

The present invention relates to an improved device for assisting a person to sit down on or stand up from chairs, couches, toilets, etc. The device is easily moved from room to room by the person who intends to use the device.

TECHNOLOGY REVIEW

There are a number of known devices which assist a person in sitting down or standing up. However these devices are not portable in the sense that the person using them can easily move them from room to room as they travel around a building.

U.K. patent specification No. 1,407,033 discloses a standing aid for paraplegics. The standing aid includes a frame, and a support mounted on the frame capable of moving between a sitting position and a vertical position in which it is capable of supporting a user. A hand hold is located on the frame to allow a user sitting on the support to raise himself by pulling on the hand hold. The hand hold may be situated at the top of the frame. The support may be coupled to the user to move with the user. A locking device can be provided which can hold the support in successive positions between the sitting and vertical positions with a release mechanism situated near the hand hold. While this device has wheels for moving the device from room to room, it does not have the ability to allow the user to sit on couches, chairs, toilets, etc. It also does not have the capability of storing the support arms next with the base plate for ease of transporting of the device.

French patent No. 2,435,246 discloses a support frame for paraplegics. The support frame has a base, padded knee supports and pivoting arms to keep the standing patient upright. The frame helps the paralysed patient to lift himself from a wheelchair into a standing position and supports him in this position. The frame consists of a large base ensuring the support's stability with primary vertical supports rigidly fixed to it. A padded contoured member attached to the vertical support at knee height act as a rest for the knees as the patient is pulling himself upright.

An upper frame has two pivoted arms which are moved apart as the patient is maneuvering himself and are closed about him with the padded ends supporting his buttocks once he is upright. This device does not allow the patient to transport the device from room to room because of its overall size. There is also no way to remove the support arms and store them next to the base plate for transporting the device.

U.S. Pat. No. 2,757,388 to Chisholm discloses a bedside transfer stand for allowing an invalid to be assisted from a bed to a wheelchair or from the wheelchair back into bed again. The transfer stand is provided between the bed and the wheelchair so that the patient can rise and stand on the transfer stand and then be turned whereby the patient can sit down on the bed or wheelchair, as the case may be. The transfer stand includes an automatic lock which prevents turning except when intentionally done and while forcibly unlocked. The Chisholm transfer stand does not allow the user to remove the support arms and store them next to the base plate for transporting the device from room to room.

An improved portable standing and sitting aid is required which can be easily moved from room to room for assisting a person to sit down on or stand up from chairs, couches, toilets, etc.

SUMMARY OF THE INVENTION

It is an object of the present invention to provide a device for assisting people in sitting down in and standing up from chairs, couches, toilets, etc.

It is a further object of the present invention to provide a standing and sitting aid which is simple in construction and is lightweight.

It is still a further object of the present invention to provide a standing and sitting aid which can be easily moved by the user from room to room.

It is still a further object of the invention to provide a standing and sitting aid which is economical to manufacture and inexpensive for the use to purchase.

It s still a further object of the invention to provide a standing and sitting aid which has no moving parts and will be free standing.

It is still a further object of the present invention to provide a standing and sitting aid where the support arms can form a carrying handle for transporting the device.

The above and other objects are accomplished by the invention in which a portable standing and sitting device comprises a base plate for allowing the feet of the user to be placed thereon and at least one support arm connected to the base plate in an initial position for permitting the user to grasp the support arm thereby allowing the user's arm and shoulder to assist in the standing or sitting operation. The support arm is removable from the initial position for assisting in transporting the device from room to room.

This device is particularly useful for persons who suffer from Arthritis, Rheumatism, Obesity, those who are stroke victims, as well as anyone who has difficulty in sitting or standing.

BRIEF DESCRIPTION OF THE DRAWINGS

The invention may be better understood by referring to the detailed description of the invention when taken in conjunction with the accompanying drawings in which.

DESCRIPTION OF THE PREFERRED EMBODIMENTS

Figure 1:
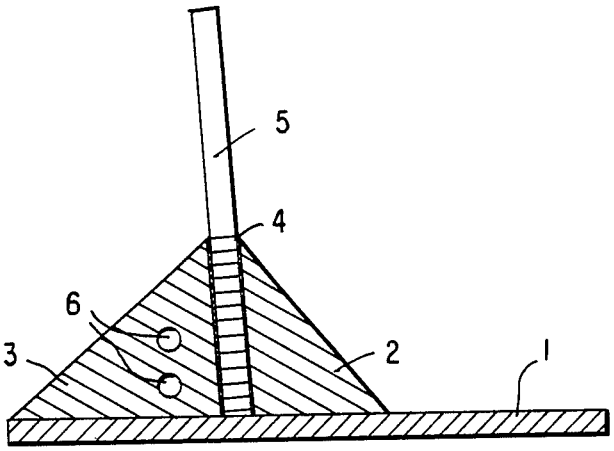
FIG. 1 is a side view showing the base plate and a support arm in a preferred embodiment of the present invention.

FIG. 1 discloses a base plate 1 which has attached thereto front and rear braces 2,3. The front and rear braces 2,3 support a slot means 4 which can receive a support arm 5 therein. The slot means 4 can be cylindrical or any other shape which can accommodate the support arm 5. The support arm 5 is removably disposed in the slot means 4 by way of a screw connection or any other easily removable connection. Another example of the type of connection between the slot means 4 and the support arm 5 is that the support arm 5 can be provided with a protrusion which fits into a J-shaped slot in the slot means 4 so that the support arm 5 can be slid into the slot means 4 and twisted to lock the support arm 5 in place. It is also possible to make the front and rear braces 2,3 integral so that they can support the slot means 4 on all of its sides. There is also the possibility that the support arms 5 can be connected to the slot means 4 by just a slide connection if the tolerances between the two members is properly set.

At least one of the braces 2,3 can be provided with holes 6 therethrough for slidably receiving the support arms 5. When the support arms 5 are disposed in the holes 6 they can act as a carrying handle for assisting the person in transporting the device from room to room.

Figure 2:
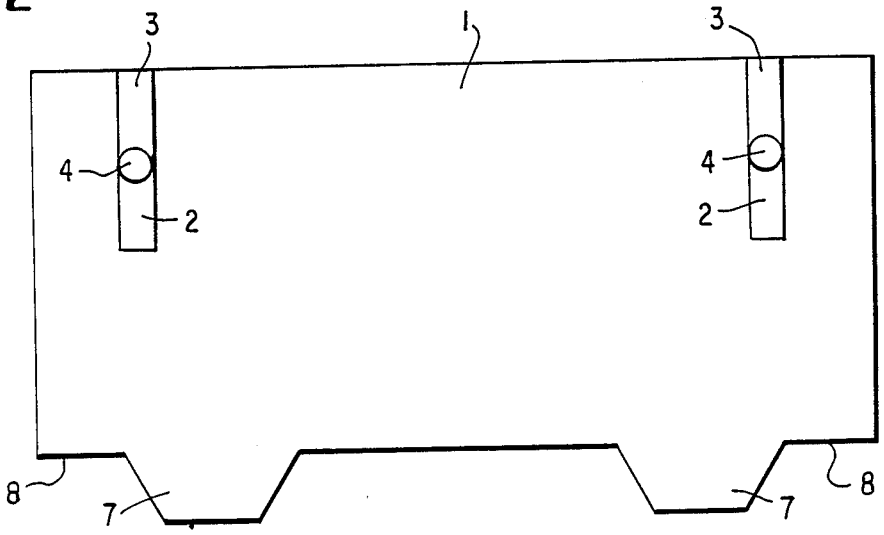
FIG. 2 is a top view of the embodiment shown in FIG. 1 illustrating the base plate and braces, the support arms are removed in this showing.

FIG. 2 discloses the base plate 1 and braces 2,3 with the support arms 5 removed. The base plate 1 includes extended regions 7 which are included for the purpose of allowing the heel of the user's foot to be placed completely on the base plate 1. The extended regions 7 allow the downward pressure of the user's feet to equalize the pull on the support arms 5 when the user is rising or sitting, thereby preventing tilting of the base plate 1. The base plate 1 also includes regions 8 where material has been removed so that the base plate does not interfere with the chair legs on which the user is sitting.

Figure 3:
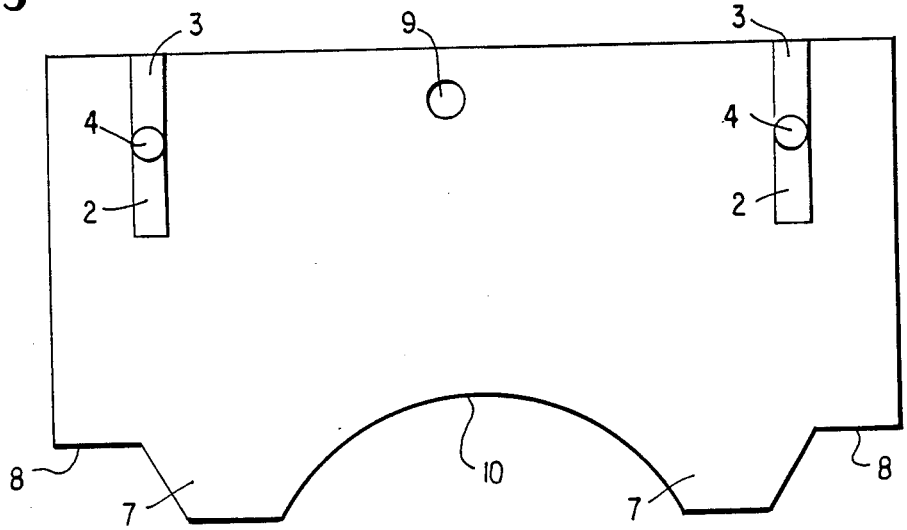
FIG. 3 is a top view of the base plate and braces showing another preferred embodiment of the present invention.

FIG. 3 discloses another embodiment of the base plate 1. In this embodiment the base plate 1 has a region 10 where material has been removed so that the base plate does not interfere with the lower surface of a toilet. This region 10 allows the base plate 1 to be positioned so that it abuts the lower surface of the toilet.

Figure 4:
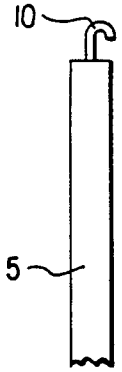
FIG. 4 is a side view of one embodiment of the support arm which includes a hook located at its free end.

The base plate 1 can also be provided with a loop or ring mechanism 9 attached thereto for allowing the person to pick up the base plate 1 without bending over. This can be accomplished by utilizing a support arm 5 which is provided with a hook 10 at its end which is not received in the slot means 4, as shown in FIG. 4.

Figure 5:
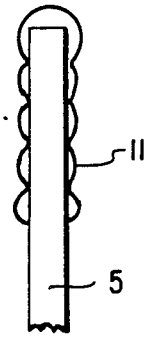
FIG. 5 is a side view of another embodiment of the support arm which includes a handle located at its free end.

FIG. 5 discloses an alternative embodiment for the support arm 5 which includes a handle 11 disposed at its end which is not received in the slot means 4. It is also possible to provide the handle 11 with a hook such as that shown in FIG. 4.

Figure 6:
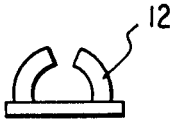
FIG. 6 is a side view of a snap attachment which can be utilized for attaching the support arm to the base plate.

FIG. 6 discloses another method of attaching the support arms 5 to the base plate 1. FIG. 6 illustrates a snap connection 12 which can be mounted to the base plate 1, in a horizontal position for ease in carrying, at a location where the support arms will not interfere with the braces 2,3. The snap connection 12 allows the support arm 5 to be pressed through the resilient arms of the snap connection 12 and then hold the support arm 5 therein. When the user wishes to remove the support arm 5 from the snap connection 12 they just lift up with a sufficient pressure to release the support arm 5 from the resilient arms. It is possible to use two or more snap connections 12 on the base plate for added support of the support arms 5.

Figure 7:
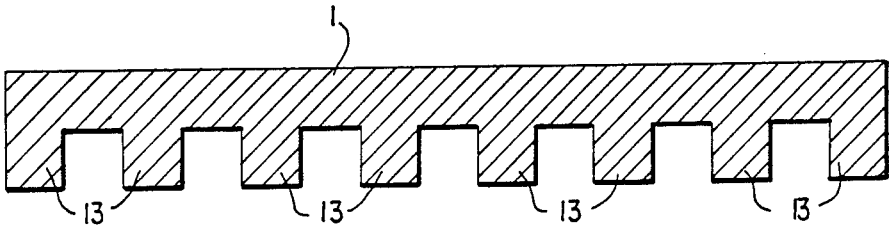
FIG. 7 is a cross sectional view of the base plate showing one type of reinforcing rib on the bottom surface thereof.

The standing and sitting aid can be made out of many different types of materials, for example aluminum, steel, metal alloys, plastic or reinforced plastics. The main concern in selecting a material is that it be strong and lightweight. It is also contemplated to reinforce the base plate with ribs on its lower surface to thereby provide a sturdy structure which will not bend when used. FIG. 7 discloses one embodiment of the reinforcing ribs 13 located on the lower surface of the base plate 1. The ribs 13 may also have many other cross sectional configurations.

Figure 8:
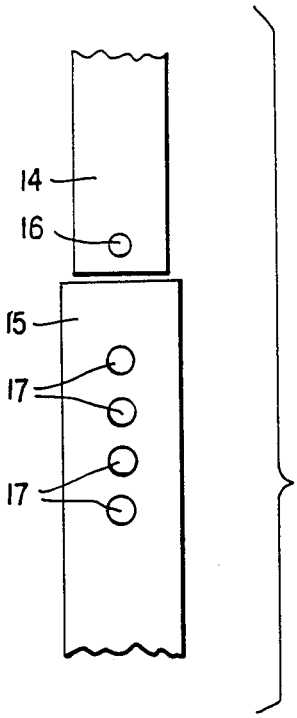
FIG. 8 is a side view of a support arm showing the adjustable height feature.

It is contemplated to provide the standing and sitting aid with support arms which are adjustable in length. This will allow people of different stature to adjust the length of support arms 5 to their desired length. FIG. 8 discloses one embodiment of a support arm which is adjustable in height. This support arm is made of an upper part 14 which can slide into a lower part 15. Upper part 14 includes a pin 16 which may be spring biased so that it extends further than the diameter of the upper part 14. The pin 16 is configured to fit into the holes 17 provided in the lower part 15. Adjusting the height of the arm can be accomplished by pushing the pin 16 in so that the upper part 14 can be slid inside the lower part 15 and when the pin 16 aligns with a hole 17 the spring bias forces the pin 16 into the hole 17, thereby locking the two parts 14 and 15. It is also possible for many other types of adjustability to be used for the support arm. Another example would be to have the pin 16 replaced by a hole that went completely through the upper part 14 and likewise have the holes 17 extend completely through the lower part 15. Then an additional pin could be provided which would extend completely through the respective holes to lock the two parts 14 and 15 together.

The operation of the standing and sitting aid will now be discussed. When a person is sitting on a couch, chair, toilet, etc., the base plate 1 is positioned so that the heels of the feet of the person can be placed entirely on the base plate 1. The person then leans forward and grasps at least one support arm 5 and then begins to rise. As the person rises, their weight on the base plate 1 prevents the base plate 1 from tilting as their arms and shoulders pull against the upright support arms to assist in the standing operation. Once standing, the person can remove the support arms 5 from the slot means 4 and they can place them in the holes 6 or in the snap connection 12. They can then carry the standing and sitting aid to the next location where they wish to sit down and can replace the support arms 5 in the slot means 4. Then standing on the base plate 1 with their hands grasping the support arms 5, they can sit down onto the chair, couch, toilet, etc.

It is also contemplated to include a handle on the base plate 1, either integral with or separately attached thereto, in case the user would like an alternative method of carrying the device.

It will be understood that the above description of the present invention is susceptible to various modifications, changes and adaptations, and the same are intended to be comprehended within the meaning and range of equivalents of the appended claims.

What is claimed is:

1. A portable standing and sitting device, comprising:

a base plate adapted to allow the feet of a person to be placed thereon;

two support arms connected to said base plate in an initial position and adapted to permit the person to grasp said support arms thereby allowing the person's arms and shoulders to assist them in a standing or sitting operation, said support arms being removable from said initial position to assist in transporting said device and when said support arms are in said initial position, said support arms are set apart to such an extent to allow the person to walk between said support arms; and a brace means connected to said base plate for connecting said support arm to said base plate, said brace means including a means defining a slot for receiving said support arm and a brace member attached to said slot defining means for providing additional support to said slot defining means, said brace member includes a means defining an opening in said brace member for slidably receiving at least one of said support arms when said support arms are removed from said slot defining means, and wherein at least one of said support arms, when placed in said opening, acts as a handle for transporting said device from room to room.

2. A portable standing and sitting device as defined in claim 1, wherein said base plate is generally rectangular with portions of said base plate being removed along a rear edge so that said rear edge of said base plate can be slid under a chair and avoid contacting the front chair legs.

3. A portable standing and sitting device as defined in claim 2, wherein said base plate also includes another portion along said rear edge being removed and contoured so that said base plate can abut the lower surface of a toilet.

4. A portable standing and sitting device as defined in claim 1, wherein said base plate includes a portion along a rear edge of said base plate which is removed and contoured so that said base plate can abut the lower surface of a toilet.

5. A portable standing and sitting device as defined in claim 1, wherein each said support arm includes a handle disposed at one end adapted for allowing the hand of the person to grasp said handle of said support arm.

6. A portable standing and sitting device as defined in claim 1, wherein said base plate includes a loop mechanism attached thereto and at least one of said support arms include a hooking means for picking up said base plate by said loop mechanism without the person having to bend over.

7. A portable standing and sitting device as defined in claim 1, wherein said base plate includes at least one snap mechanism for attaching one of said support arms to said base plate when said support arms are removed from said initial position.

8. A portable standing and sitting device as defined in claim 1, wherein said support arms are adjustable in height.

9. A portable standing and sitting device as defined in claim 1, wherein said device is made of aluminum.

10. A portable standing and sitting device as defined in claim 1, wherein said device is made of plastic.

11. A portable standing and sitting device as defined in claim 1, wherein said device is made of steel.

12. A portable standing and sitting device as defined in claim 1, wherein said device is made of a metal alloy.

13. A portable standing and sitting device as defined in claim 1, wherein said device is made of a fiber reinforced plastic.

14. A portable standing and sitting device as defined in claim 1, wherein said base plate includes reinforcing ribs on its lower surface.

15. A portable standing and sitting device, comprising:

a base plate adapted to allow the feet of a person to be placed thereon;

two support arms connected to said base plate in an initial position to permit the person to grasp said support arms thereby allowing the person's arms and shoulders to assist in a standing or sitting operation, said support arms being removable from said initial position to assist in transporting said device; and a plurality of snap mechanisms attached to said base plate for attaching said support arms thereto when said support arms are removed from said initial position, whereby at least one of said support arms can act as a handle for transporting the device from room to room.

16. A portable standing and sitting device, comprising:

a base plate adapted to allow the feet of a person to be placed thereon; and at least one support arm connected to said base plate in an initial position adapted to permit said person to grasp said support arm thereby allowing said person's arm and shoulder to assist in a standing or sitting operation, said support arm being removable from said initial position to assist in transporting said device and wherein said base plate includes at least one snap for attachment of said support arm to said base plate when said support arm is removed from said initial position.

* * * * *